United States Patent [19]

Boraca

[11] Patent Number: 5,046,876

[45] Date of Patent: Sep. 10, 1991

[54] SAFETY TIPPED PENCIL AND SHARPENER THEREFOR

[76] Inventor: Robert Boraca, 2130 Walnut, Park Ridge, Ill. 60068

[21] Appl. No.: 574,368

[22] Filed: Aug. 24, 1990

[51] Int. Cl.[5] ..... B43K 29/06; B43L 23/00

[52] U.S. Cl. ..... 401/50; 30/457; 30/454; 144/28.11

[58] Field of Search ..... 401/50, 51; 30/451, 30/452, 454–462; 144/28.1, 28.11, 28.3

[56] References Cited

U.S. PATENT DOCUMENTS

| | | | |
|---|---|---|---|
| 691,127 | 1/1902 | Fox | 144/28.11 |
| 1,026,671 | 5/1912 | Hager et al. | 30/454 |
| 2,625,943 | 1/1953 | Prey | 401/51 |
| 2,702,022 | 2/1955 | Fors | 30/458 X |

FOREIGN PATENT DOCUMENTS

| | | | |
|---|---|---|---|
| 341619 | 11/1989 | European Pat. Off. | 401/51 |
| 364501 | 11/1922 | Fed. Rep. of Germany | 30/456 |
| 632626 | 8/1937 | Fed. Rep. of Germany | 30/454 |
| 193707 | 3/1923 | United Kingdom | 30/453 |

*Primary Examiner*—Danton D. DeMille
*Attorney, Agent, or Firm*—Lee, Mann, Smith, McWilliams & Sweeney

[57] ABSTRACT

A pencil and a shrapener for forming the pencil with a safety tip comprising a curved, circular surface. In cross-section, the curved surface appears as two intersecting circles. The tip is thus a curved, circular surface of revolution with a sufficient radius to the surface of revolution such that the pencil has a relatively blunt writing tip.

20 Claims, 1 Drawing Sheet

SAFETY TIPPED PENCIL AND SHARPENER THEREFOR

BACKGROUND OF THE INVENTION

This invention relates to writing instruments, and in particular to a safety-tipped pencil which largely prevents the possibility of puncture wounds by the tip when sharpened.

Pencils of the nature of the invention are normally formed of wood, plastic or composite materials in a generally elongated, cylindrical configuration with a central core of writing graphite or other similar material. When sharpened in a conventional pencil sharpener of any type, the tip of the pencil is formed in a steep conical configuration, which, while easy to hold, is also quite sharp. In the hands of small children, such a tip can become dangerous, either due to accidental or inadvertent use of the pencil, or malicious use of the pencil as a weapon. Skin puncture wounds and eye injuries are unfortunate and common results of a normal sharp-tipped pencil. Often, young children are given large diameter pencils, but even such pencils, with a sharpened tip, are as dangerous as the normal diameter pencil.

Writing instruments have been proposed with tips other than that of the pointed pencil. For example, U.S. Pat. No. 1,861,466 discloses a crayon holder where the crayon has a rounded tip. U.S. Pat. No. 2,409,000 discloses a crayon having a core of writing lead for strengthening the crayon, the core having a generally flat tip. Typically, however, pencils or crayons are sharpened with a conical shape, and can be sharpened to a potentially dangerous point.

SUMMARY OF THE INVENTION

The invention relates to a pencil having a generally elongated, cylindrical configuration of a particular diameter and with a central axis and a central core of writing material surrounded by a sheath of sharpenable material. As an improvement over prior pencils, the pencil of the present invention has a safety tip comprising a curved, circular surface which, in longitudinal cross-section through the central axis of the pencil, is comprised of two circles intersecting at a pencil point. Each of the intersecting circles has an identical radius in the range from greater than three-quarters of the diameter of the pencil to less than the diameter of the pencil, and each circle has a center laterally offset beyond the central axis of the pencil at a location greater than one-quarter and less than one-half of the diameter of the pencil. This results in a circular surface of revolution which has a relatively blunt tip, which is quite adequate for writing purposes, but which is much less likely to cause injury, either through inadvertent use, or through malicious misuse.

In accordance with the preferred form of the invention, the radius of each circle is in the range from 80 to 90% of the diameter of the pencil, and the offset is about 35% of the diameter of the pencil. This results in a quite rounded configuration which has the writing material still protruding sufficiently for proper use of the pencil.

For sharpening of the pencil, a sharpener is provided having means for retaining the pencil in proper alignment for sharpening, and having sharpening means in registration with the retaining means for sharpening the pencil. The means for sharpening conforms to the desired shape of the tip, and includes a blade for shaping the tip of the pencil such that in longitudinal cross section through the central axis of the pencil, the tip is bounded by two circles intersecting at the pencil point, each circle having an identical radius in the range from greater than three quarters the diameter of the pencil to less than the diameter of the pencil, each circle also having its center laterally offset beyond the central axis of the pencil at a location greater than one quarter and less than one half of the diameter of the pencil.

In accordance with the disclosed and preferred form of the invention, the sharpener comprises a small, hand-held device in which the retaining means comprises a guide hole for insertion of the pencil. The blade is installed in the device and has a curved, quarter circular cutting surface for properly forming the tip of the pencil.

BRIEF DESCRIPTION OF THE DRAWING

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
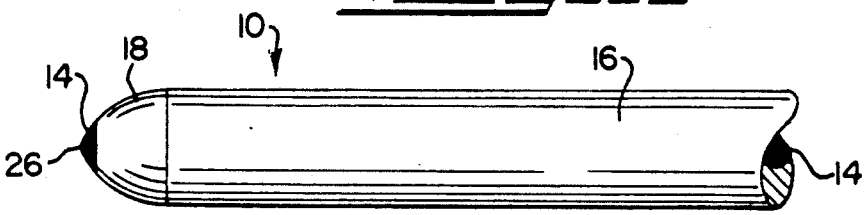
FIG. 1 is an elevational view of a pencil according to the invention, the full length not being shown as unnecessary.

A pencil according to the invention is shown generally at 10 in FIG. 1. The pencil 10 is similar to a conventional pencil, having a generally elongated, cylindrical configuration of a desired diameter, with a central axis 12 (FIG. 2), a central core 14 of writing material such as graphite, and a surrounding sheath 16 of sharpenable material, such as wood, plastic, composites or other suitable types of material.

Figure 2:
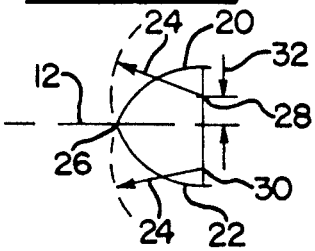
FIG. 2 is a schematic cross-sectional view of the tip of the pencil according to the invention showing the configuration thereof.

The pencil 10 has a safety tip 18. The geometry of the tip 18 is best shown in FIG. 2, the tip 18 comprising a curved, circular surface which, in longitudinal cross section through the central axis 12, is bounded by two identical intersecting circles 20 and 22. Each of the circles 20 and 22 has an identical radius 24, with the circles 20 and 22 intersecting to form a pencil point 26.

Each of the circles 20 and 22 has the radius 24 in the range from greater than three quarters the diameter of the pencil 10 to somewhat less than the diameter of the pencil 10. Preferably, the radius 24 is in the range from 80 to 90% of the diameter of the pencil 10. Also, as shown in FIG. 2, the center 28 of the circle 20 and the center 30 of the circle 22 are each offset laterally beyond the central axis 12 at a location greater than one quarter and less than one half of the diameter of the pencil 10. Preferably, the offset of each of the centers 28 and 30 is about 35% of the diameter of the pencil 10. The offset of the center 28 is depicted by arrows 32 in FIG. 2, it being understood that the offset of the center 30 would be identical. Thus, the tip 18 is a curved, circular surface of revolution.

Figure 3:
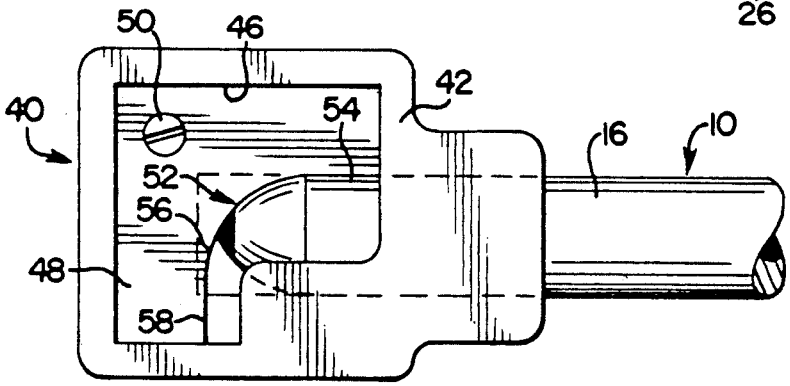
FIG. 3 is a top plan view of a sharpener for a pencil according to the invention, showing a pencil engaged therein and fully sharpened.
Figure 4:
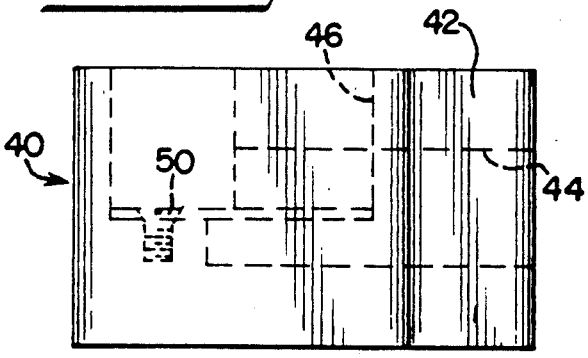
FIG. 4 is a side elevational illustration of the sharpener of FIG. 3.
Figure 5:
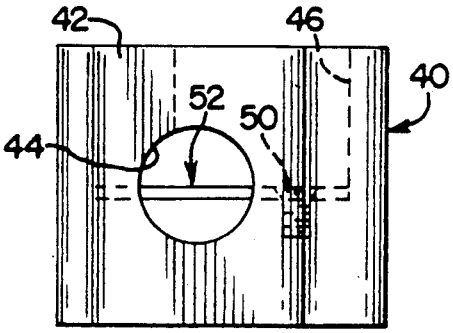
FIG. 5 is an end elevational illustration of the sharpener of FIG. 3 from the end having the hole for insertion of the pencil, and with the pencil absent.

A sharpener 40 for providing the sharpened tip 18 is shown in FIGS. 3 through 5. The sharpener 40 is composed of a housing 42, formed of plastic or the like, having a longitudinal guide hole 44 for accommodating a pencil 10. The housing 42 includes a recess 46, partially connected to the guide hole 44, and in which a blade 48 is located. The blade 48 is held in place by a screw 50.

The blade 48 includes a cutting edge 52 composed of three segments, a straight segment 54, a quarter circle segment 56 and a straight segment 58. The quarter circle segment 56 has a radius identical to the radius 24 so that the tip 18 can be formed in the sharpener 40 as shown. The blade 48 is appropriately positioned within the housing 42 so that the cutting edge 52 is presented to a pencil 10 in a proper orientation for complete sharpening to the form shown in FIG. 1.

While the sharpener 40 has been illustrated as a particular type of normally hand-held sharpener for the pencil 10, it will be evident to those skilled in the art that other types of sharpeners are possible. So long as the geometrical relationships described above are employed, other types of sharpeners, such as rotary sharpeners, can be properly configured and are within the scope of the invention.

Various changes can be made to the invention without departing from the spirit thereof or scope of the following claims.

What is claimed is:

1. In a pencil having a generally elongated, cylindrical configuration of a particular diameter with a central axis and a central core of writing material surrounded by a sheath of sharpenable material, the improvement comprising a safety tip having a central writing area and comprising a curved, circular surface which, in longitudinal cross section through said central axis, is defined by two circles intersecting at said area, each circle having an identical radius in the range from greater than three-quarters the diameter of the pencil to less than the diameter of the pencil, each circle having a center horizontally offset beyond said central axis at a location greater than one-quarter and less than one-half of the diameter of the pencil.

2. A pencil according to claim 1 in which the radius of each circle is in the range from about 80 to 90 percent of the diameter of the pencil.

3. A pencil according to claim 1 in which said offset is about 35 percent of the diameter of the pencil.

4. A pencil according to claim 1 in which the radius of each circle is in the range from about 80 to 90 percent of the diameter of the pencil and said offset is about 35 percent of the diameter of the pencil.

5. In a pencil having a generally elongated, cylindrical configuration of a particular diameter with a central axis and a central core of writing material surrounded by a sheath of sharpenable material, the improvement comprising a safety tip comprising a curved, circular surface of revolution defined by a circle having a radius of from greater than three-quarters the diameter to less than the diameter of the pencil, the circle having a center laterally offset beyond said central axis at a location greater than one-quarter and less than one-half of the diameter of the pencil.

6. A pencil according to claim 5 in which the radius of the circle is in the range from about 80 to 90 percent of the diameter of the pencil.

7. A pencil according to claim 5 in which said offset is about 35 percent of the diameter of the pencil.

8. A pencil according to claim 5 in which the radius of the circle is in the range from about 80 to 90 percent of the diameter of the pencil and said offset is about 35 percent of the diameter of the pencil.

9. A sharpener for forming a pencil with a safety tip comprising a curved, circular surface, the sharpener comprising a. means for retaining a pencil in alignment for sharpening, and b. means in registration with said retaining means for sharpening the pencil, said means for sharpening including means for shaping the tip of the pencil such that in longitudinal cross section through the central axis of the pencil the tip is bounded by two circles intersecting at a central writing area, each circle having an identical radius in the range from greater than three-quarters the diameter of the pencil to less than the diameter of the pencil, each circle having a center laterally offset beyond said central axis at a location greater than one-quarter and less than one-half of the diameter of the pencil.

10. A sharpener according to claim 9 in which the radius of each circle is in the range from about 80 to 90 percent of the diameter of the pencil.

11. A sharpener according to claim 9 in which said offset is about 35 percent of the diameter of the pencil.

12. A sharpener according to claim 9 in which the radius of each circle is in the range from about 80 to 90 percent of the diameter of the pencil and said offset is about 35 percent of the diameter of the pencil.

13. A sharpener according to claim 9 in which said retaining means comprises a guide hole.

14. A sharpener according to claim 9 in which said means for sharpening comprises a blade having a curved quarter circular cutting surface.

15. A sharpener for forming a pencil with a safety tip comprising a curved, circular surface, the sharpener comprising a. means for retaining a pencil in alignment for sharpening, and b. means in registration with said retaining means for sharpening the pencil, said means for sharpening including means for shaping the tip of the pencil to a curved, circular surface of revolution defined by a circle having a radius of from greater than three-quarters the diameter to less than the diameter of the pencil, the circle having a center laterally offset beyond said central axis at a location greater than one-quarter and less than one-half of the diameter of the pencil.

16. A sharpener according to claim 15 in which the radius of the circle is in the range from about 80 to 90 percent of the diameter of the pencil.

17. A sharpener according to claim 15 in which said offset is about 35 percent of the diameter of the pencil.

18. A sharpener according to claim 15 in which the radius of the circle is in the range from about 80 to 90 percent of the diameter of the pencil and said offset is about 35 percent of the diameter of the pencil.

19. A sharpener according to claim 15 in which said retaining means comprises a guide hole.

20. A sharpener according to claim 15 in which said means for sharpening comprises a blade having a curved quarter circular cutting surface.

* * * * *